US006666679B1

(12) United States Patent
Ye

(10) Patent No.: US 6,666,679 B1
(45) Date of Patent: Dec. 23, 2003

(54) UTILITY LIGHTER WITH AN IMPROVED CHILD SAFETY DEVICE

(75) Inventor: Ya Wei Ye, Ningbo (CN)

(73) Assignee: Easton Enterprises, Inc., Buena Park, CA (US)

( * ) Notice: Subject to any disclaimer, the term of this patent is extended or adjusted under 35 U.S.C. 154(b) by 0 days.

(21) Appl. No.: 10/313,608

(22) Filed: Dec. 6, 2002

(51) Int. Cl.[7] ..... F23D 11/36; F23Q 7/12
(52) U.S. Cl. ..... 431/153; 431/255; 431/345
(58) Field of Search ..... 431/153, 255, 431/345, 266; 126/408, 401, 410, 25 B

(56) References Cited

U.S. PATENT DOCUMENTS

| | | | | |
|---|---|---|---|---|
| 5,284,439 A | * | 2/1994 | Shike et al. | 431/255 |
| 5,697,775 A | | 12/1997 | Saito et al. | |
| 5,897,308 A | | 4/1999 | Saito et al. | |
| 6,022,212 A | | 2/2000 | Saito et al. | |
| 6,039,562 A | * | 3/2000 | Li | 431/255 |
| 6,042,367 A | | 3/2000 | Saito et al. | |
| 6,093,017 A | | 7/2000 | Saito et al. | |
| 6,217,313 B1 | * | 4/2001 | Luo | 431/255 |

* cited by examiner

*Primary Examiner*—James C. Yeung

(74) *Attorney, Agent, or Firm*—Thomas I. Rozsa; Tony D. Chen

(57) ABSTRACT

A utility lighter with improved child safety device, having a handle portion and a nozzle portion, a fuel tank contained in the handle portion for supplying fuel, a valve assembly contained in the handle portion and connected to the fuel tank for controlling the supply of the fuel, and a trigger movably mounted to the handle portion for actuating upon the valve assembly such that when the trigger is actuated, the valve assembly is opened to release fuel from the fuel tank to an outlet port of the nozzle portion. The utility light also has a piezo-electric ignitor unit contained in the handle portion and having a telescoping inner shaft and a telescoping sleeve, the relative movement of which causing electric sparks to be generated at the outlet port of the nozzle portion, wherein the telescoping inner shaft is fixed to and remains stationary with the handle portion, and the telescoping sleeve is connected to and moving together with the trigger, and a safety locking member mounted to the handle portion and movable between a locking position at which it prevents movement of the trigger and the telescoping sleeve of the piezo-electric unit, and an unlocking position at which it permits movement of the trigger and the telescoping sleeve of the piezo-electric unit. Only when the safety locking member is actually moved to the unlocking position, the trigger can be depressed to cause the valve assembly to open to release fuel at the outlet port of the nozzle portion and also cause the piezo-electric ignitor unit to generate electrical sparks at the outlet port of the nozzle portion, to thereby produce a flame

13 Claims, 4 Drawing Sheets

UTILITY LIGHTER WITH AN IMPROVED CHILD SAFETY DEVICE

BACKGROUND OF THE INVENTION

1. Field of the Invention

The present invention generally relates to the field of utility lighters used for igniting barbecue grills, fireplaces, campfires, and candles, etc. More particularly, the present invention relates to the field of utility lighter having an improved child safety device for preventing children from igniting the utility lighter.

2. Description of the Prior Art

Conventional utility lighter are well known in the art and are widely used by consumers for igniting barbecue grills, fireplaces, campfires, and candles, etc. Existing utility lighters typically have a handle portion and an extended nozzle portion. The handle portion often contains a fuel container, a valve assembly, a piezo-electric unit, and a trigger. The nozzle portion often contains a fuel conduit connected to the fuel container and vale assembly. When the trigger is actuated, gaseous fuel is released by the valve assembly through the nozzle, and the piezo-electric unit generates a spark at the nozzle to ignite the released fuel. Continued depression of the trigger will cause the valve assembly to remain open so that the flame is sustained. When the trigger is released, the valve assembly is closed to stop the fuel supply so the lighter is extinguished.

Various safety devices have also been developed to be incorporated into utility lighters for preventing the unintended use of the utility lighters. Early safety devices often incorporate an "on/off" switch for locking the trigger or the valve assembly when the utility lighter is not used. However, it has been discovered that such "on/off" switches could not effectively prevent children from playing with the utility lighters because the "on/off" switches could easily be switched by children.

In recent years other more sophisticated safety devices have been introduced for utility lighters. For example, U.S. Pat. Nos. 5,697,775, 5,897,308, 6,022,212, 6,042,367 and 6,093,017 all issued to Saito et al. for "Safety Device in Lighting Rods" have disclosed several child safety devices for utility lighters that utilize various shaped locking members for locking the unintended movement of the trigger. However, there remains a need to design and develop a new safety device that is effective while easy to operate.

In addition, in existing utility lighters, the piezo-electric unit is arranged such that the telescopic inner shaft is moving with the trigger, which often results in damage in the piezo-electric unit and reduces its life. It is therefore also desirable to design a new utility lighter that eliminate the movement of the telescopic inner shaft, therefore makes the piezo-electric unit more durable.

SUMMARY OF THE INVENTION

The present invention is a utility lighter with improved child safety device.

It is an object of the present invention to provide a utility lighter with an improved child safety device that is not designed to be operated by a thumb but rather is designed to be operated by other fingers in conjunction with the finger that presses the trigger, therefore making it more difficult for a child to ignite the utility lighter.

It is also an object of the present invention to provide a utility lighter with a reversed piezo-electric unit arrangement where the telescopic inner shaft is not moving with the trigger but rather fixed to the body frame of the handle portion of the utility lighter, to thereby increase the life of the piezo-electric unit.

Described generally, the present invention is a utility lighter having a handle portion and a nozzle portion. A fuel tank is contained in the handle portion for supplying fuel, and a valve assembly id also contained in the handle portion and connected to the fuel tank for controlling the supply of the fuel. A trigger is movably mounted to the handle portion for actuating upon the valve assembly such that when the trigger is actuated, the valve assembly is opened to release fuel from the fuel tank to an outlet port of the nozzle portion. A piezo-electric ignitor unit is contained in the handle portion and having a telescoping inner shaft and a telescoping sleeve, the relative movement of which causing electric sparks to be generated at the outlet port of the nozzle portion, wherein the telescoping inner shaft is fixed to and remains stationary with the handle portion, and the telescoping sleeve is connected to and moving together with the trigger.

The utility lighter further incorporates a safety locking member mounted to the handle portion and movable between a locking position at which it prevents movement of the trigger and the telescoping sleeve of the piezo-electric unit, and an unlocking position at which it permits movement of the trigger and the telescoping sleeve of the piezo-electric unit. The safety locking member is biased towards the locking position such that the safety locking member remains at its locking position unless being actually moved to the unlocking position. Only when the safety locking member is actually moved to the unlocking position, the trigger can be depressed to cause the valve assembly to open to release fuel at the outlet port of the nozzle portion and also cause the piezo-electric ignitor unit to generate electrical sparks at the outlet port of the nozzle portion, to thereby produce a flame.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
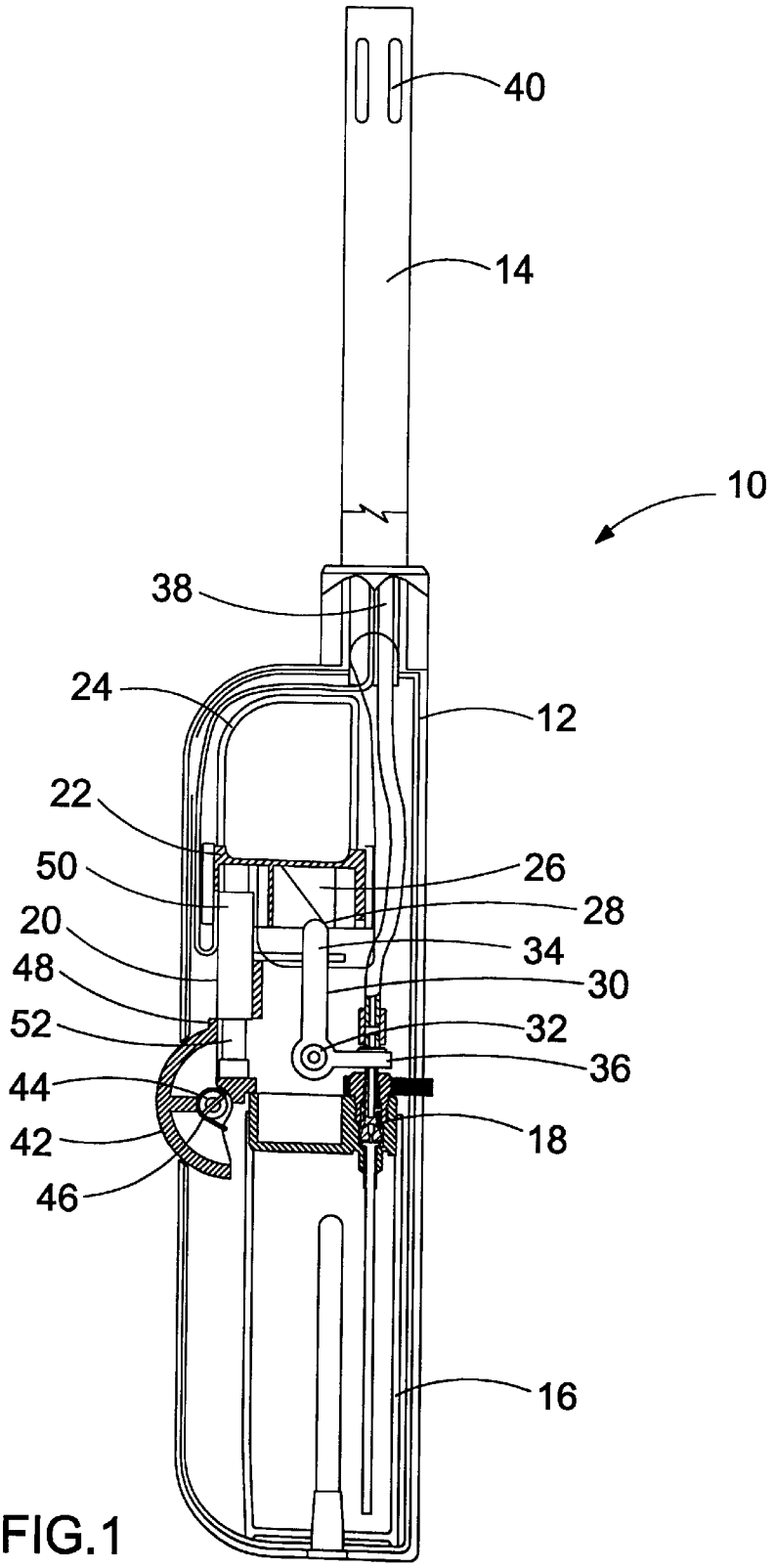
FIG. 1 an open side elevation view of the present invention utility lighter, showing major components thereof, and also showing the trigger in a locked condition.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 4, there is shown at 10 the present invention utility lighter. The utility lighter 10 has a handle portion 12 and an extended nozzle portion 14. Inside the handle portion 12 there is housed a fuel tank 16 and a valve assembly 18, and a piezo-electric igniter unit 20. A trigger 22 is located in an opening 24 of the handle portion 12. A small triangular shaped ramp member 26 is fixed to and moves together with trigger 22. The ramp member 26 has an inclined surface 28. An "L" shaped lever member 30 is pivotally mounted on a small cylindrical hinge shaft 32. The distal top end 34 of the longitudinal long arm of the L-shaped lever member 30 is engaged with the inclined surface 28 of the ramp member 26, and the distal end 36 of the transverse short arm of the L-shaped lever member 30 is attached to the valve assembly 18, such that when the trigger 22 is depressed, the downward movement of the ramp member 26 will cause the L-shaped lever member 30 to pivot counterclockwisely, which in turn causes the valve assembly 18 to open to release fuel from the fuel tank 16 through the fuel supply pipe 38 to the top outlet 40 of the nozzle 14.

A locking member 42 is provided to lock the movement of the trigger 22 for child safety purposes. The locking member 42 has a rocking cam shaped configuration and is pivoted on a small cylindrical hinge shaft 44 with a spring 46 installed thereon for biasing the locking member 42 in the clockwise direction, such that normally (as shown in FIG. 1), the top end 48 of the locking member 42 is engaged with the bottom end of the telescoping sleeve 50 of the piezo-electric igniter unit 20 which prevents downward movement of the telescoping sleeve 50 so that the piezo-electric igniter unit 20 is inoperative. This also prevents the downward movement of the trigger 20 since the telescoping sleeve 50 of the piezo-electric igniter unit 20 is fixed with the trigger 22.

Figure 2:
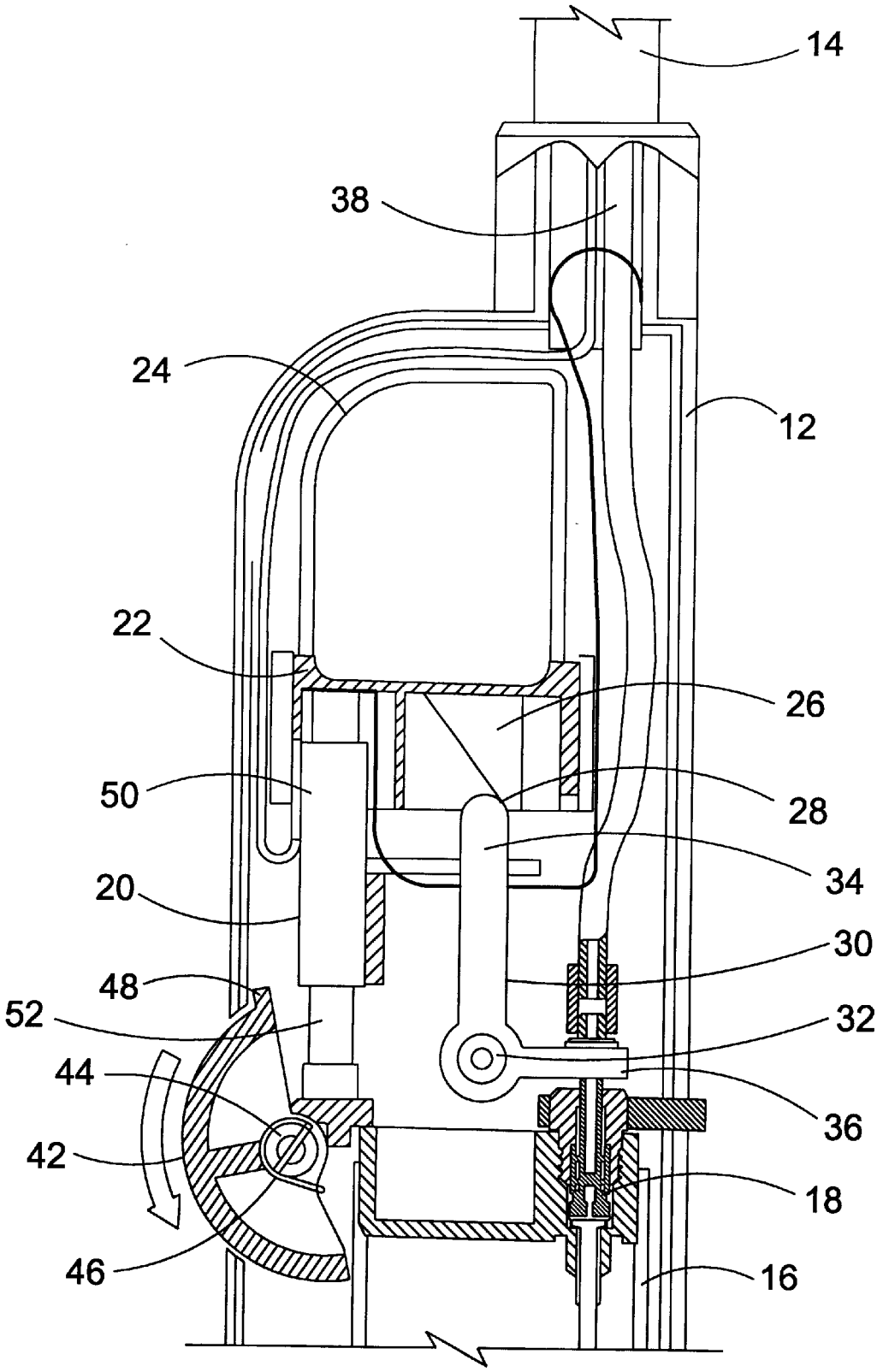
FIG. 2 is an enlarged open and partial side elevation view of the present invention utility lighter, showing the trigger in an unlocked condition.

When the locking member 42 is moved along the counterclockwise direction, its top end 48 will disengage from the bottom end of the telescoping sleeve 50 of the piezo-electric igniter unit 20, so that the telescoping sleeve 50 of the piezo-electric igniter unit 20 can move downwardly on the telescoping inner shaft 52 (as shown in FIG. 2). This also clears the way for the downward movement of the trigger 22.

Figure 3:
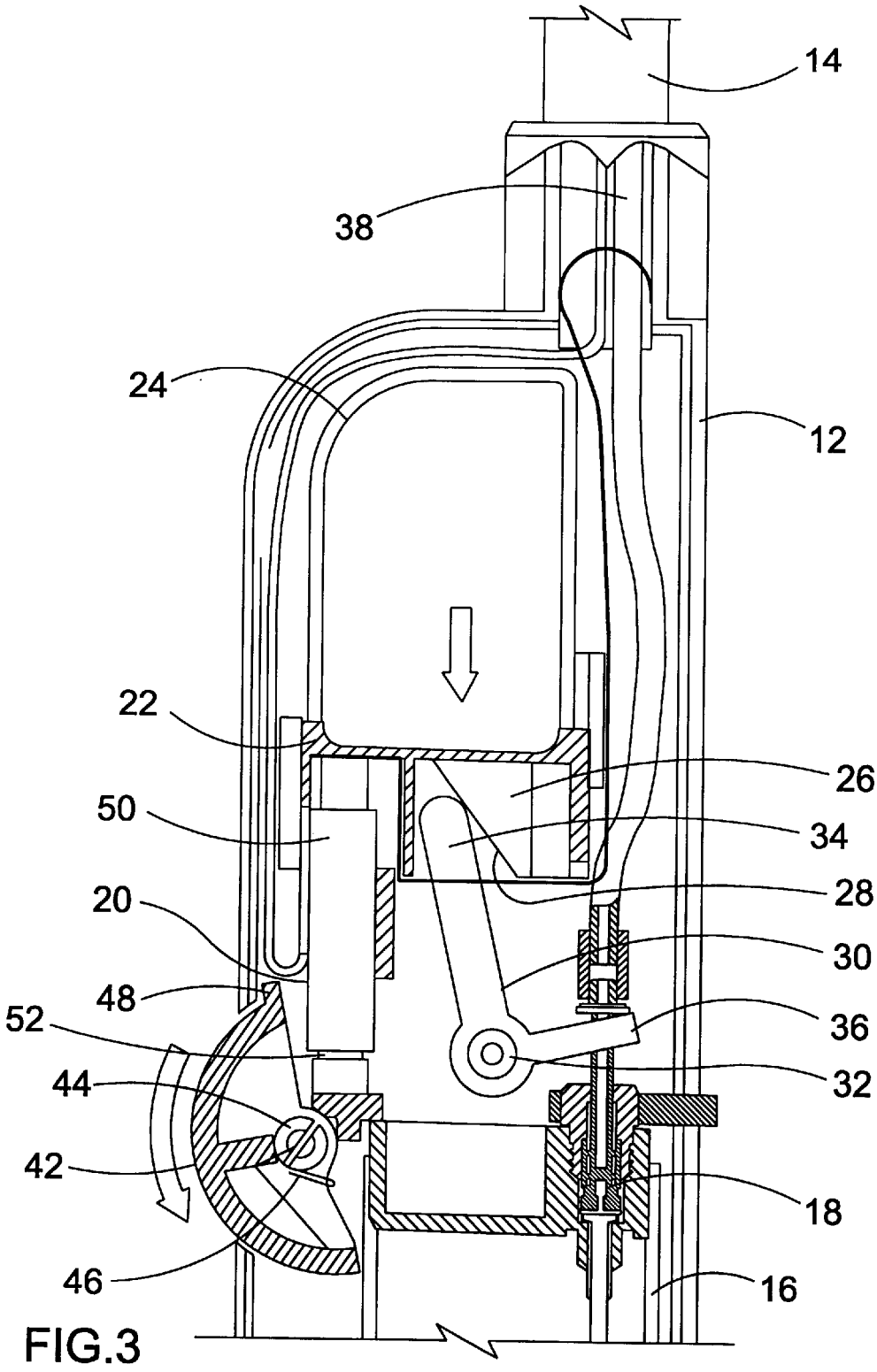
FIG. 3 is an enlarged open and partial side elevation view of the present invention utility lighter, showing the trigger being pressed when it is unlocked to ignite the lighter.
Figure 4:
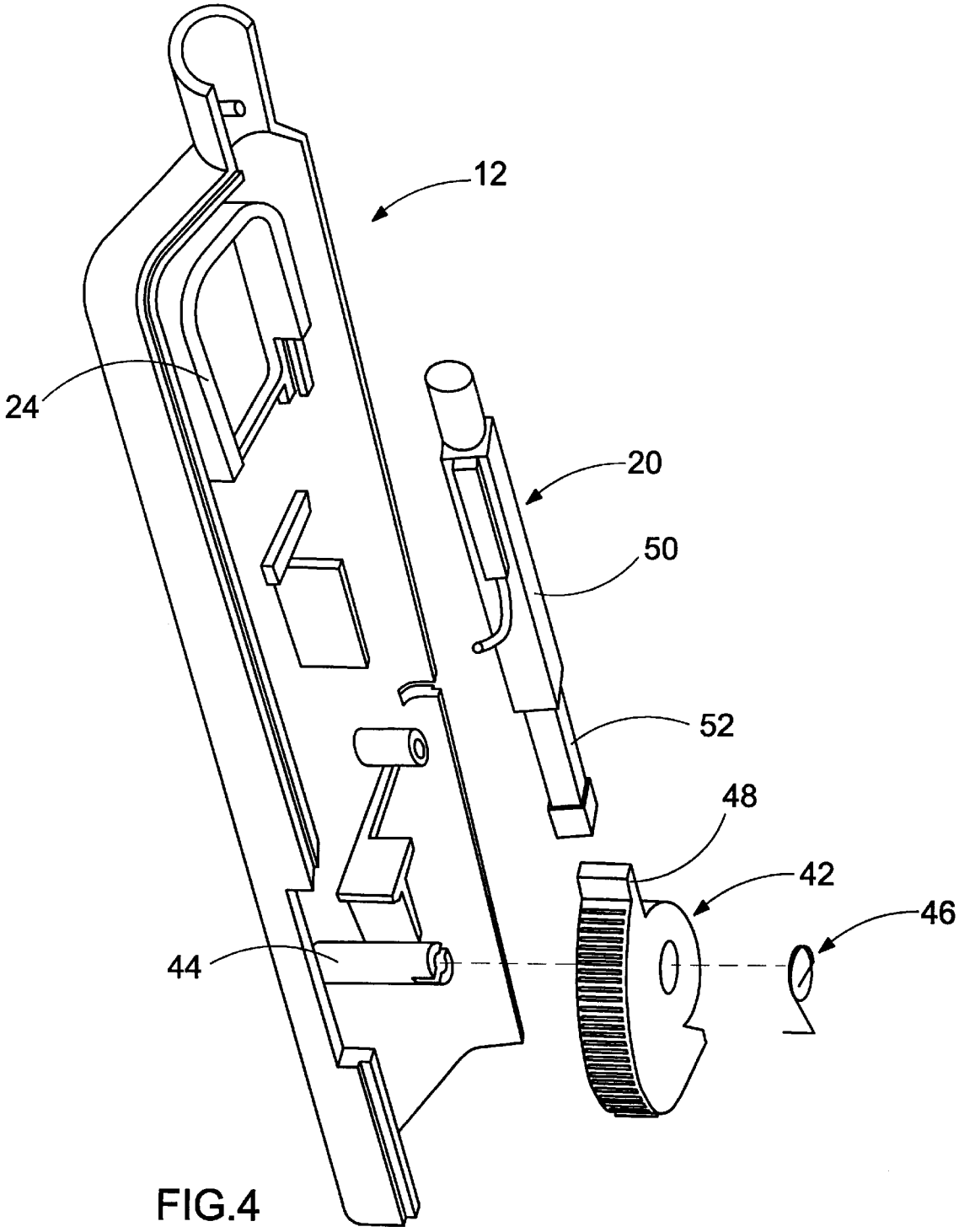
FIG. 4 is an enlarged exploded partial view of the present invention utility lighter, showing the locking member and the reverse arrangement of the piezo-electric unit.

As shown in FIG. 3, when the trigger 22 is depressed (after the locking member 42 is turned counterclockwisely), the telescoping sleeve 50 of the piezo-electric igniter unit 20 is moving down together with the trigger 22 and along the telescoping sleeve 50 of the piezo-electric igniter unit 20. This will cause the piezo-electric igniter unit 20 to generate an electrical spark at the top outlet 40 of the nozzle 14. Meanwhile, the downward movement of the ramp member 26 causes the L-shaped lever member 30 to pivot counterclockwisely, which in turn causes the valve assembly 18 to open to release gaseous fuel from the fuel tank 16 through the fuel supply pipe 38 to the top outlet 40 of the nozzle 14. The electrical spark will then ignite the gaseous fuel to produce a flame.

When the user releases the trigger 22, the telescoping sleeve 50 of the piezo-electric igniter unit 20 will return upwardly to its original position under the bias of internal spring means (not shown) of the piezo-electric igniter unit 20. This also causes the trigger 22 to return upwardly to its original position, which in turn allows the L-shaped lever member 30 to return clockwisely to its original position which will cause the valve assembly 18 to open to stop the releasing of fuel from the fuel tank 16. As a result, the flame will be extinguished. As the same time, the locking member 42 will also return clockwisely under the bias of spring 46, such that its top end 48 will again engage with the bottom end of the telescoping sleeve 50 of the piezo-electric igniter unit 20 for preventing the downward movement of the telescoping sleeve 50 of the piezo-electric igniter unit 20 and the trigger 22.

The present invention utility lighter with improved child safety device has many advantages. It provides a utility lighter with an improved child safety device that is designed to be operated by other fingers in conjunction with the one that operates the trigger, therefore making it more difficult for a child to ignite the utility lighter. It also provide a utility lighter with a reversed piezo-electric unit arrangement where the telescopic inner shaft is not moving with the trigger but rather fixed to the body frame of the handle portion of the utility lighter, so the piezo-electric unit is more durable.

Defined in detail, the present invention is a utility lighter, comprising: (a) a handle portion and an extended nozzle portion; (b) a fuel tank contained in the handle portion for supplying gaseous fuel through a gas pipe in the nozzle portion to an outlet port at an distal end of the nozzle portion; (c) a valve assembly contained in the handle portion and connected between the fuel tank and the gas pipe for controlling the supply of the gaseous fuel; (d) a trigger movably mounted in an opening of the handle portion and actuating upon the valve assembly through a pivoted lever member such that when the trigger is depressed, the valve assembly is opened to release gaseous fuel from the fuel tank through the gas pipe to the outlet port of the nozzle portion; (e) a piezo-electric ignitor unit contained in the handle portion and having a telescoping inner shaft and a telescoping sleeve, the relative movement of which causing electric sparks to be generated at the outlet port of the nozzle portion through electrical conducting wires in the nozzle portion, wherein the telescoping inner shaft is fixed to and remains stationary with the handle portion, and the telescoping sleeve is connected to and moving together with the trigger; (f) a safety locking member pivotally mounted to the handle portion and movable between a locking position at which it prevents movement of the trigger and the telescoping sleeve of the piezo-electric unit, and an unlocking position at which it permits movement of the trigger and the telescoping sleeve of the piezo-electric unit; and (g) means for biasing the safety locking member towards the locking position such that the safety locking member remains at its locking position unless being actually moved to the unlocking position; (h) whereby only when the safety locking member is actually moved to the unlocking position, the trigger can be depressed to cause the valve assembly to open to release gaseous fuel at the outlet port of the nozzle portion and also cause the piezo-electric ignitor unit to generate electrical sparks at the outlet port of the nozzle portion, to thereby produce a flame.

Defined broadly, the present invention is a utility lighter, comprising: (a) a handle portion and a nozzle portion; (b) a fuel tank contained in the handle portion for supplying fuel; (c) a valve assembly contained in the handle portion and connected to the fuel tank for controlling the supply of the fuel; (d) a trigger movably mounted to the handle portion for actuating upon the valve assembly such that when the trigger is actuated, the valve assembly is opened to release fuel from the fuel tank to an outlet port of the nozzle portion; (e) a piezo-electric ignitor unit contained in the handle portion and having a telescoping inner shaft and a telescoping sleeve, the relative movement of which causing electric sparks to be generated at the outlet port of the nozzle portion, wherein the telescoping inner shaft is fixed to and remains stationary with the handle portion, and the telescoping sleeve is connected to and moving together with the trigger; (f) a safety locking member mounted to the handle portion and movable between a locking position at which it prevents movement of the trigger and the telescoping sleeve of the piezo-electric unit, and an unlocking position at which it permits movement of the trigger and the telescoping sleeve of the piezo-electric unit; and (g) means for biasing the safety locking member towards the locking position such that the safety locking member remains at its locking position unless being actually moved to the unlocking position; (h) whereby only when the safety locking member is actually moved to the unlocking position, the trigger can be depressed to cause the valve assembly to open to release fuel at the outlet port of the nozzle portion and also cause the piezo-electric ignitor unit to generate electrical sparks at the outlet port of the nozzle portion, to thereby produce a flame.

Defined more broadly, the present invention is a utility lighter, comprising: (a) a handle portion and a nozzle portion; (b) a fuel tank contained in the handle portion for supplying fuel; (c) a valve assembly contained in the handle portion and connected to the fuel tank for controlling the supply of the fuel; (d) a trigger movably mounted to the handle portion for actuating upon the valve assembly such that when the trigger is actuated, the valve assembly is opened to release fuel from the fuel tank to an outlet port of the nozzle portion; (e) a piezo-electric ignitor unit contained in the handle portion and having a telescoping inner shaft and a telescoping sleeve, the relative movement of which causing electric sparks to be generated at the outlet port of the nozzle portion, wherein the telescoping inner shaft is fixed to and remains stationary with the handle portion, and the telescoping sleeve is connected to and moving together with the trigger; and (f) a safety locking member mounted to the handle portion and movable between a locking position at which it prevents movement of the trigger and the telescoping sleeve of the piezo-electric unit, and an unlocking position at which it permits movement of the trigger and the telescoping sleeve of the piezo-electric unit; (g) whereby only when the safety locking member is actually moved to the unlocking position, the trigger can be depressed to cause the valve assembly to open to release fuel at the outlet port of the nozzle portion and also cause the piezo-electric ignitor unit to generate electrical sparks at the outlet port of the nozzle portion, to thereby produce a flame.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A utility lighter, comprising:

a. a handle portion and an extended nozzle portion;

b. a fuel tank contained in said handle portion for supplying gaseous fuel through a gas pipe in said nozzle portion to an outlet port at an distal end of said nozzle portion;

c. a valve assembly contained in said handle portion and connected between said fuel tank and said gas pipe for controlling the supply of said gaseous fuel;

d. a trigger movably mounted in an opening of said handle portion and actuating upon said valve assembly through a pivoted lever member such that when the trigger is depressed, said valve assembly is opened to release gaseous fuel from said fuel tank through said gas pipe to said outlet port of said nozzle portion;

e. a piezo-electric ignitor unit contained in said handle portion and having a telescoping inner shaft and a telescoping sleeve, the relative movement of which causing electric sparks to be generated at said outlet port of said nozzle portion through electrical conducting wires in said nozzle portion, wherein the telescoping inner shaft is fixed to and remains stationary with said handle portion, and the telescoping sleeve is connected to and moving together with said trigger;

f. a safety locking member pivotally mounted to said handle portion and movable between a locking position at which it prevents movement of said trigger and said telescoping sleeve of said piezo-electric unit, and an unlocking position at which it permits movement of said trigger and said telescoping sleeve of said piezo-electric unit, wherein said safety locking member has a protruding end engageable with a proximal end of said telescoping sleeve of said piezo-electric ignitor unit for preventing movement of said telescoping sleeve and said trigger when said safety locking member is at said locking position; and g. means for biasing said safety locking member towards said locking position such that said safety locking member remains at its locking position unless being actually moved to said unlocking position;

h. whereby only when said safety locking member is actually moved to said unlocking position, said trigger can be depressed to cause said valve assembly to open to release gaseous fuel at said outlet port of said nozzle portion and also cause said piezo-electric ignitor unit to generate electrical sparks at said outlet port of said nozzle portion, to thereby produce a flame.

2. The utility lighter in accordance with claim 1, wherein said safety locking member has a rocking cam shaped configuration.

3. The utility lighter in accordance with claim 1, wherein said safety locking member is pivoted on a small cylindrical hinge shaft inside said handle portion.

4. The utility lighter in accordance with claim 1, wherein biasing means comprises a spring.

5. A utility lighter, comprising:

a. a handle portion and a nozzle portion;

b. a fuel tank contained in said handle portion for supplying fuel;

c. a valve assembly contained in said handle portion and connected to said fuel tank for controlling the supply of said fuel;

d. a trigger movably mounted to said handle portion for actuating upon said valve assembly such that when the trigger is actuated, said valve assembly is opened to release fuel from said fuel tank to an outlet port of said nozzle portion;

e. a piezo-electric ignitor unit contained in said handle portion and having a telescoping inner shaft and a telescoping sleeve, the relative movement of which causing electric sparks to be generated at said outlet port of said nozzle portion, wherein the telescoping inner shaft is fixed to and remains stationary with said handle portion, and the telescoping sleeve is connected to and moving together with said trigger;

f. a safety locking member mounted to said handle portion and movable between a locking position at which it prevents movement of said trigger and said telescoping sleeve of said piezo-electric unit, and an unlocking position at which it permits movement of said trigger and said telescoping sleeve of said piezo-electric unit, wherein said safety locking member has a protruding end engageable with a proximal end of said telescoping sleeve of said piezo-electric ignitor unit for preventing movement of said telescoping sleeve and said trigger when said safety locking member is at said locking position; and g. means for biasing said safety locking member towards said locking position such that said safety locking member remains at its locking position unless being actually moved to said unlocking position;

h. whereby only when said safety locking member is actually moved to said unlocking position, said trigger can be depressed to cause said valve assembly to open to release fuel at said outlet port of said nozzle portion and also cause said piezo-electric ignitor unit to generate electrical sparks at said outlet port of said nozzle portion, to thereby produce a flame.

6. The utility lighter in accordance with claim 5, wherein said safety locking member has a rocking cam shaped configuration.

7. The utility lighter in accordance with claim 5, wherein said safety locking member is pivoted on a hinge shaft inside said handle portion.

8. The utility lighter in accordance with claim 5, wherein biasing means comprises a spring.

9. A utility lighter, comprising:

a. a handle portion and a nozzle portion;

b. a fuel tank contained in said handle portion for supplying fuel;

c. a valve assembly contained in said handle portion and connected to said fuel tank for controlling the supply of said fuel;

d. a trigger movably mounted to said handle portion for actuating upon said valve assembly such that when the trigger is actuated, said valve assembly is opened to release fuel from said fuel tank to an outlet port of said nozzle portion;

e. a piezo-electric ignitor unit contained in said handle portion and having a telescoping inner shaft and a telescoping sleeve, the relative movement of which causing electric sparks to be generated at said outlet port of said nozzle portion, wherein the telescoping inner shaft is fixed to and remains stationary with said handle portion, and the telescoping sleeve is connected to and moving together with said trigger; and f. a safety locking member mounted to said handle portion and movable between a locking position at which it prevents movement of said trigger and said telescoping sleeve of said piezo-electric unit, and an unlocking position at which it permits movement of said trigger and said telescoping sleeve of said piezo-electric unit, wherein said safety locking member has a protruding end engageable with a proximal end of said telescoping sleeve of said piezo-electric ignitor unit for preventing movement of said telescoping sleeve and said trigger when said safety locking member is at said locking position;

g. whereby only when said safety locking member is actually moved to said unlocking position, said trigger can be depressed to cause said valve assembly to open to release fuel at said outlet port of said nozzle portion and also cause said piezo-electric ignitor unit to generate electrical sparks at said outlet port of said nozzle portion, to thereby produce a flame.

10. The utility lighter in accordance with claim 9, wherein said safety locking member has a rocking cam shaped configuration.

11. The utility lighter in accordance with claim 9, wherein said safety locking member is pivoted on a hinge shaft inside said handle portion.

12. The utility lighter in accordance with claim 9, further comprising means for biasing said safety locking member towards said locking position such that said safety locking member remains at its locking position unless being actually moved to said unlocking position.

13. The utility lighter in accordance with claim 12, wherein biasing means comprises a spring.

* * * * *